US005267414A

United States Patent [19]

Vaida

[11] Patent Number: 5,267,414

[45] Date of Patent: Dec. 7, 1993

[54] LOUVER ASSEMBLY

[76] Inventor: George Vaida, Canada L-4 Alturas del Remanso, Rio Piedras, P.R. 00926

[21] Appl. No.: 912,257

[22] Filed: Jul. 13, 1992

[51] Int. Cl.[5] ..... E06B 7/08

[52] U.S. Cl. ..... 49/74.1; 49/50; 49/91.1; 49/92.1

[58] Field of Search ..... 49/91 WS, 92 SS, 74, 49/51, 64, 50, 91.1, 92.1, 74.1

[56] References Cited

U.S. PATENT DOCUMENTS

| | | | |
|---|---|---|---|
| 3,113,355 | 12/1963 | Tracy et al. | 49/51 X |
| 3,460,289 | 8/1969 | Toth | 49/91 WS |
| 4,099,346 | 7/1978 | Isono | 49/92 SS |
| 4,481,734 | 11/1984 | Vaida | 49/91 WS |
| 4,527,355 | 7/1985 | Numakami et al. | 49/91 W S |

*Primary Examiner*—Philip C. Kannan
*Attorney, Agent, or Firm*—Ezra Sutton

[57] ABSTRACT

A louver assembly is provided which includes a frame having vertical side jambs, a head, a sill, and a central opening. A plurality of vertically-spaced, substantially-straight horizontal louver members extend across the opening between the side jambs, with each of the louver members including a closing section and an actuating section. A pivot member located between the closing section and actuating section extends across the entire louver member to provide structural strength and reinforcement of the louver members. Actuating means are attached to the actuating section of each of the louver members for actuating them between open and closed positions. Each of the louver members is pivotally mounted on the side jambs, so that when the louver members are in their closed positions, the louver members overlap the peripheral sealing fins, and the closing section of adjacent louver members overlap each other to tightly seal the louver assembly against inclement weather. Finally, the louver members are pivotally mounted off center, with the closing section being larger than the actuating section. The closing section only is exposed to the exterior, such that exterior wind conditions tend to close the louver members more tightly.

7 Claims, 4 Drawing Sheets

LOUVER ASSEMBLY

FIELD OF THE INVENTION

The present invention relates generally to louver assemblies and specifically to an improved louver assembly wherein the lower longitudinal edge of an upper louver member overlaps the pivot axis of the adjacent lower louver member, so that the upper and lower longitudinal edges of each louver member are completely supported by the pivot axes of adjacent louver members.

BACKGROUND OF THE INVENTION

U.S. Pat. No. 4,481,734 discloses a louver assembly which has generally worked well. However, it is desirable to increase the structural strength of louvers and to increase their resistance to torque. Such an arrangement would provide additional security against forced entry, a better seal between the louvers, and improved water drainage.

Accordingly, it is an object of the present invention to provide an improved louver assembly which at least triples the structural strength and resistance to torque of present louver assemblies.

It is a further object to provide increased security, a better seal between the louvers, and a locking device to make it difficult to remove the security rods from the louvers.

It is also an object of the present invention to provide louvers with a stronger axis of rotation, so that they will have a longer and trouble-free life.

SUMMARY OF THE INVENTION

Briefly, in accordance with the principles of the present invention, an improved louver assembly is provided which includes a frame having vertical side jambs, a head, a sill, and a central opening. A plurality of vertically-spaced, horizontal louver members extend longitudinally across the central opening between the side jambs, with each of the louver members including a closing section and an actuating section. Actuating means are attached to the actuating section of each of the louver members for pivoting them between open and closed positions. Each of the louver members is pivotally mounted on the side jambs, so that when the louver members are in their closed positions, the closing sections of adjacent louver members partially overlap each other, and the side edges of the louver members overlap the peripheral sealing fins to tightly seal the louver assembly against inclement weather and structurally support each louver member.

More particularly, the reinforced pivot axes of adjacent louver members cooperate, so that each louver member is supported by two reinforced pivot members, the first support being provided by the pivot member for that louver member along its upper longitudinal edge, and the second support being provided along its lower longitudinal edge by the pivot member of the next lower louver member and at each side against the peripheral sealing fins, so that each louver member is completely supported against bowing, inclement weather, and forced entry.

In addition, the louver members are pivotally mounted off center, so that the closing section is larger than the actuating section, such that exterior wind conditions actually help to close the louver members more tightly against inclement weather.

The center of rotation or pivot member of each louver is now a closed circular tube to provide stronger support than the previous design, where the member was an open tubular shape. The closed circular tube member provides improved structural strength and reinforcement for each louver member that was not present with the open member.

Additionally, each end of the security rod has a cross-lock pin to prevent movement or removal of the security rod from the closed circular tube member. This could also be achieved by a lock "C" ring, or a threaded nut, or other rod end locking devices.

Finally, the closed circular tube member makes the axis of rotation stronger, so that the pivoting of each louver will be less prone to damage, and the reinforced pivoting axis will cause the louver and louver assembly to last longer and have a more troublefree life. The pivoting action of each louver is improved by the fact that the circular tube in the louver member is slightly larger than the rod diameter. This allows rotation about the rod axis while the rod is held in the jambs by a hole or a bushing that allows the rod to rotate in the side jambs of the window.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
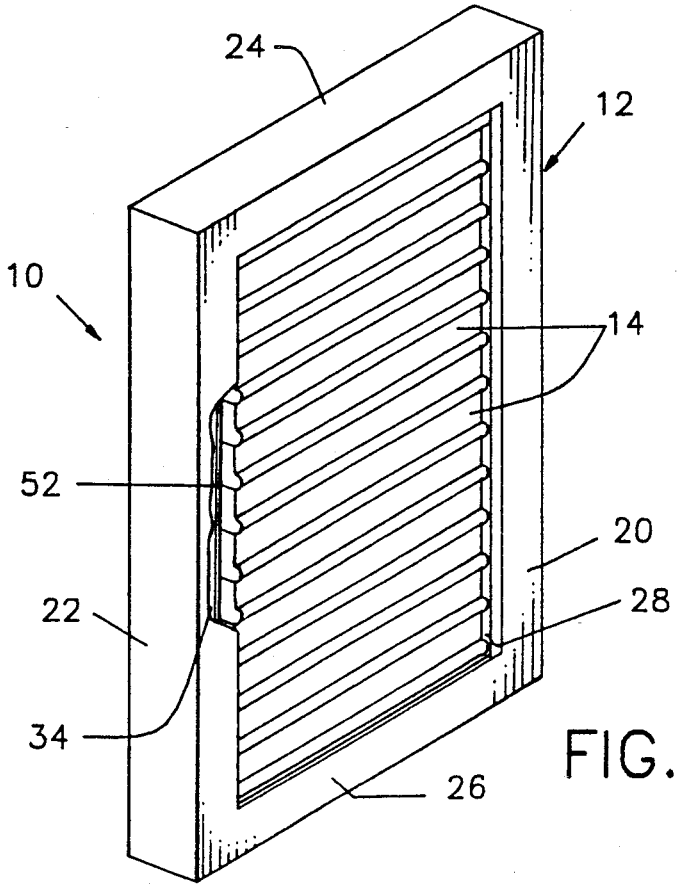
FIG. 1 is a perspective view of a louver assembly embodying the features of the present invention.
Figure 2:
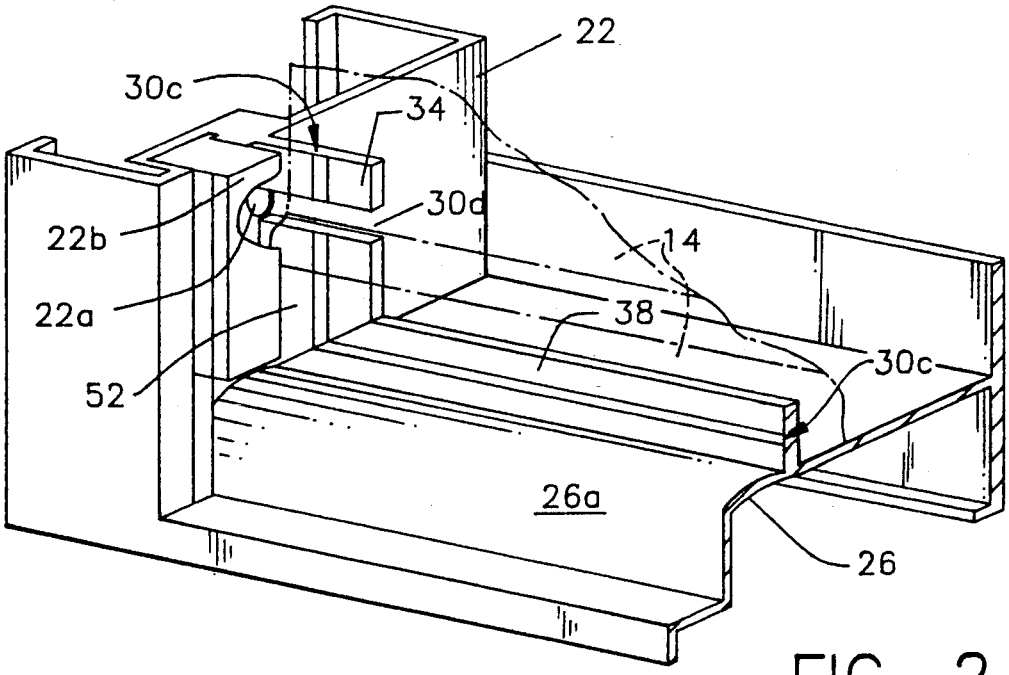
FIG. 2 is a perspective view, partially broken away, illustrating in detail the sealing fins.

For purposes of disclosure, the invention herein is illustrated as being embodied in a window 10 having a metal frame 12 with a plurality of pivotally-mounted louver members 14 mounted for adjustment by an actuator 16 (see FIG. 3) which operates to simultaneously pivot each of the louver members about horizontal axes 18 so as to open or close the window or louver assembly 10. The metal frame 12 comprises vertical side jambs 20, 22, a head 24, and a sill 26 that are formed in the present embodiment primarily from metal extrusions and which are rigidly connected to each other. Weather stripping, such as shown at **22*b***, may also be employed at various locations, if desired.

Louver members 14 are vertically spaced and are substantially straight and extend longitudinally across the central opening 28 between the side jambs 20, 22. Each of the louver members 14 includes a closing section 30 and an actuating section 32, and each closing section 30 includes an upper longitudinal edge **30*a* and a lower longitudinal edge 30*b*. Each louver member 14 rotates about its hub axis 18, which is held in place by a rod 60 that extends into a hole 22***a*, formed in side jamb 22 and a corresponding hole 20*a* formed in side jamb 20.

Sealing fins 34, with or without weatherstripping 30*c*, extend from side jambs 20, 22, and a sealing fin 36, with or without weatherstripping 30*c*, extends from head 24, and a sealing fin 38, with or without weatherstripping 30*c*, extends from sill 26 to cover the peripheral portion of central opening 28. In this manner, sealing fins 34, 36, and 38 form a substantially continuous sealing member about the periphery of central opening 28, which, as will be explained herein, cooperate with louver members 14 when in their closed positions to seal the louver assembly 10 in a weather-tight condition and give structural integrity.

Figure 3:
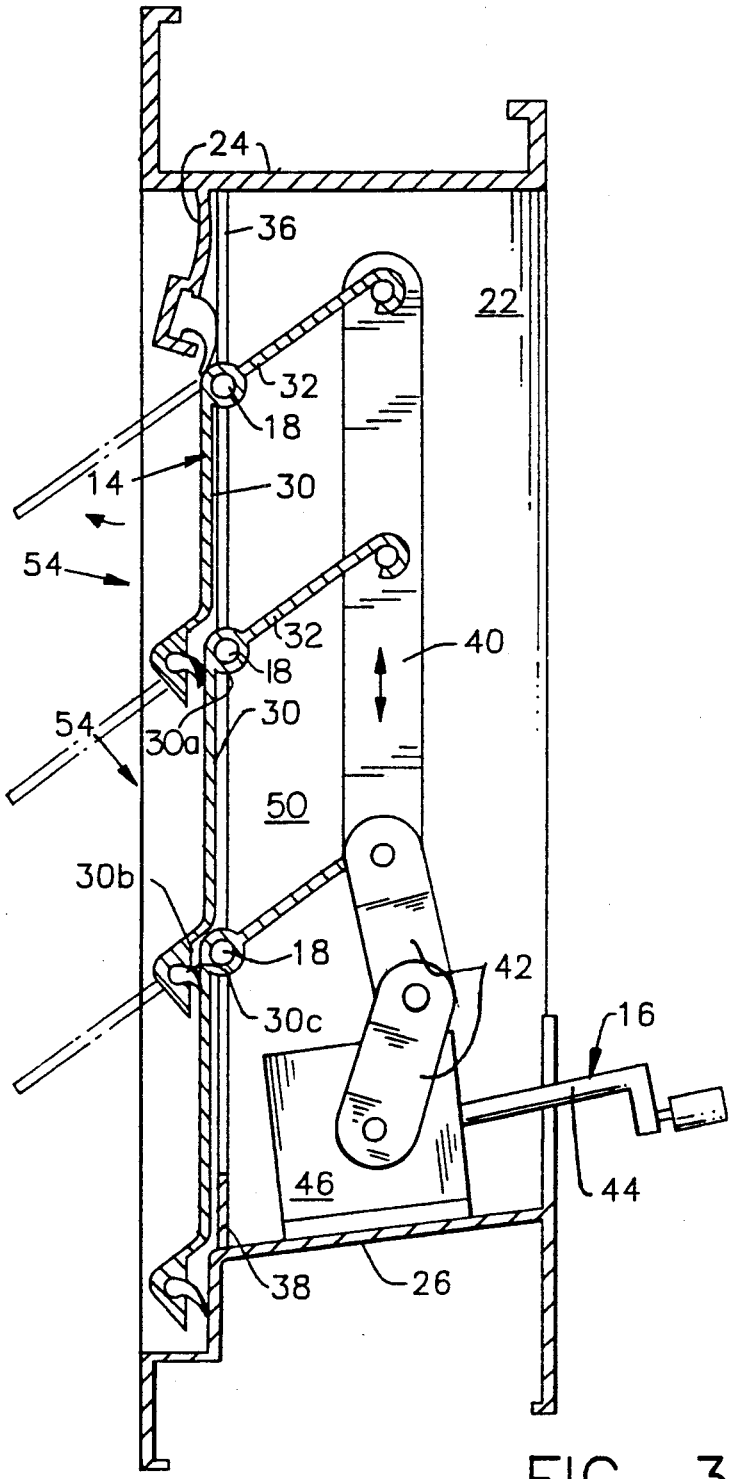
FIG. 3 is a sectional view, illustrating the louver members and actuating means therefor in detail.

Actuating means 16 are attached to the actuating section 32 of each of the louver members 14 for pivoting the louver members between open and closed positions. More particularly, each of the actuating sections 32 is connected to a vertically-extending actuating member 40, which, as shown most clearly in FIG. 3, is connected to pivotal links 42. A crank 44 and a gearbox 46 are operatively connected to links 42 and actuating member 40 to simultaneously pivot louver members 14 about their respective axes 18 between open and closed positions in a conventional manner. However, other mechanical, electrical, or hydraulic means may be used to actuate the louvers 14.

Each of the longitudinally-extending lower edges 30*b* has weather stripping 30*c* mounted therein. In addition, the side edges 30*d* of the closing section of each of the louver members are constructed to overlap a portion of sealing fins 34 mounted on respective side jambs 20, 22. In this manner, when louver members 14 are in their closed positions, the lower edge 30*b* of each closing section 30 partially overlaps the closing section 30 of the adjacent lower louver member 14 to securely seal the louver members relative to each other. In addition, when the louver members 14 are in their closed positions, the side edges 30*d* of each louver member 14 overlap the peripheral sealing fins 34 of the side jambs 20, 22 to tightly seal the louver assembly relative to the frame and thereby securely seal the louver assembly against inclement weather.

It should also be noted that each of the louver members 14 is mounted off center with respect to frame 12, so that the closing section 30 of each louver member is larger than its actuating section 32. In this manner, when louver members 14 are in their closed positions, the exterior wind-load conditions are directed against closing sections 30, and the wind-load itself operates to maintain louver members 14 in their closed positions and also operates to close louver members 14 more tightly against inclement weather.

Figure 4:
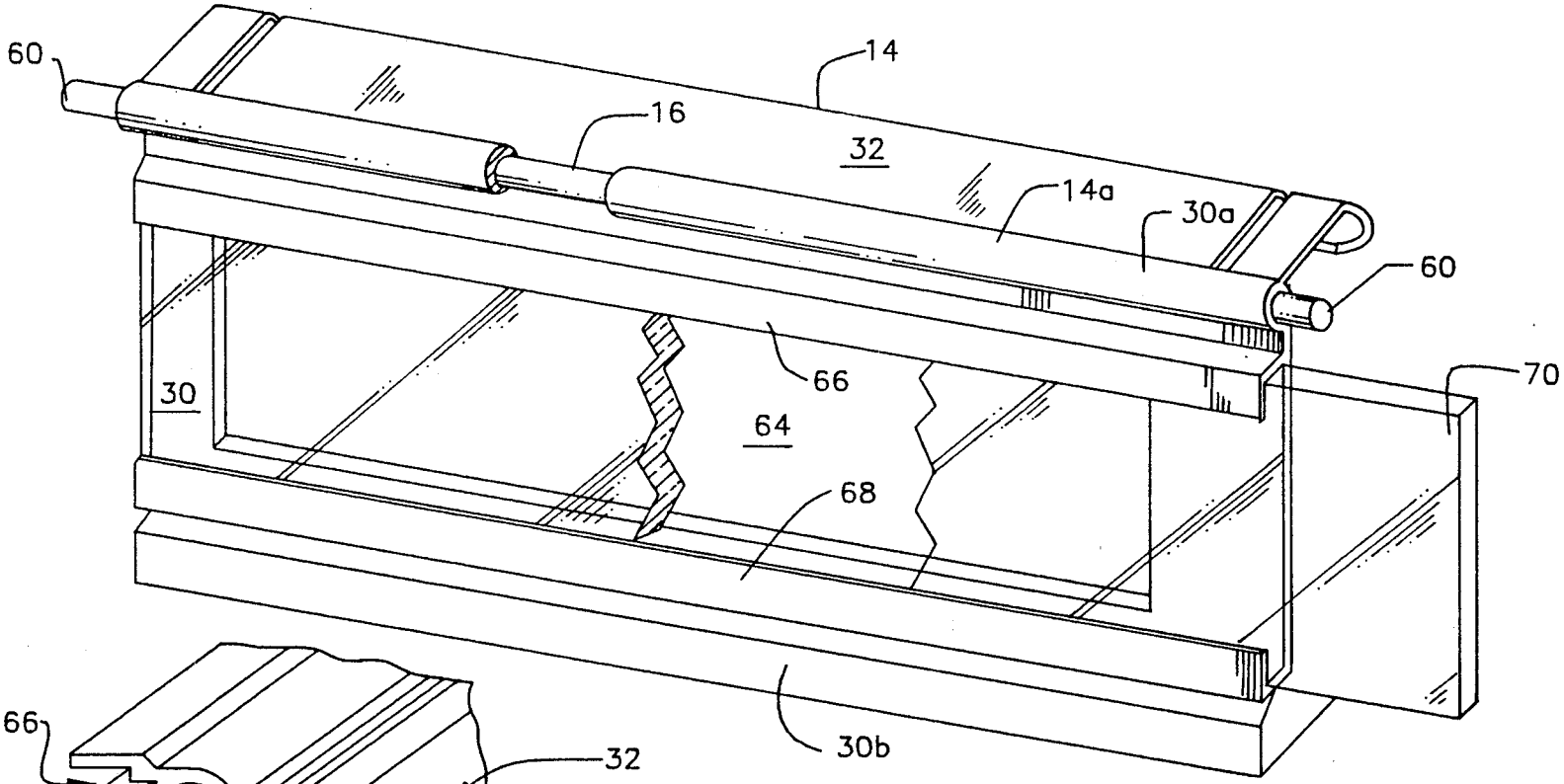
FIG. 4 is another embodiment of a louver member adapted to receive a glass insert.
Figure 5:
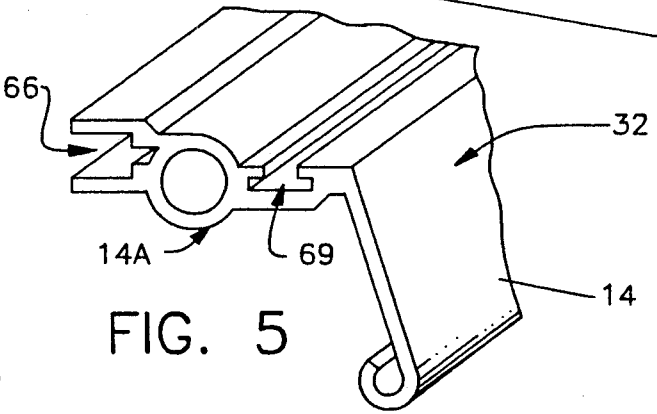
FIG. 5 is a detail view of a louver member having a closed reinforcing tube.
Figure 6:
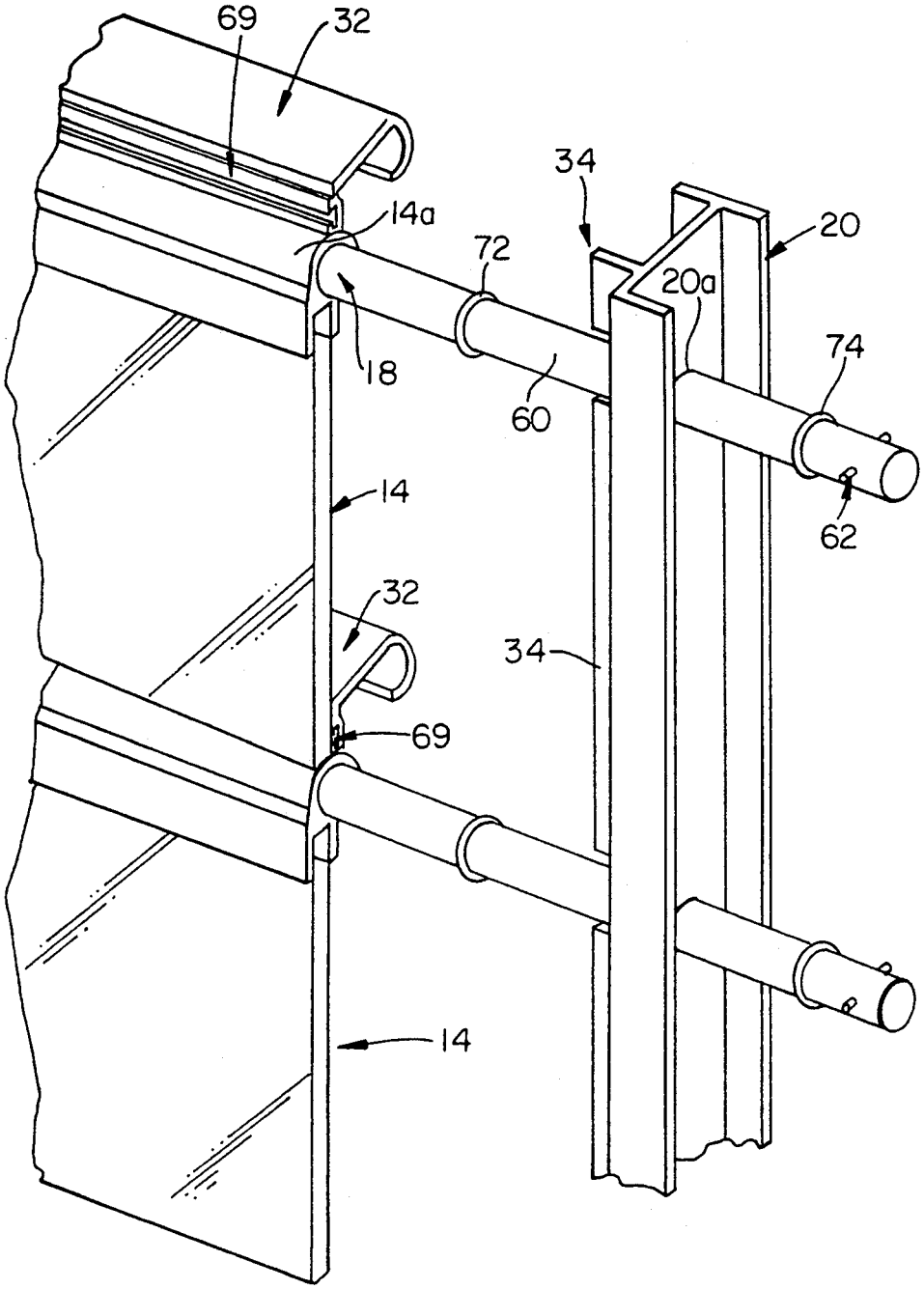
FIG. 6 is a detail view of a louver member and security rod attached to a window jamb.

Referring now specifically to FIGS. 4, 5, and 6, there is shown a closed tube bead member 14*a* which provides stronger support than the previous design. As shown in FIGS. 4 and 6, a security rod 60 extends through the pivot axis 18, which is formed by the closed tube bead member 14*a*. The security rod 60 attaches the improved louver member 14 to the window jamb 20 by extending through the window jamb 20 and having a locking pin 62 on the end of the rod 60 to prevent movement or removal of the security rod 60. Preferably, the security rod 60 is ½" in diameter and may be either solid aluminum or steel. A spacer piece 72 and a washer or a bushing 74 can be placed on either or both sides of the window jamb 20 to prevent deteriorating reactions between the louver member 14, window jamb 20, and the security rod 60.

The closed tube member 14*a* at the pivot axis 18 of each louver member 14 provides reinforcing means at the upper longitudinal edge 30*a* of the closing section of each louver member. In addition, as pointed out above, the lower longitudinal edge 30*b* of each louver member is adapted to overlap the reinforced pivot axis 18 or tube member 14*a* of the adjacent lower louver member. In this manner, the upper and lower longitudinal edges 30*a*, 30*b* of each louver member 14 are completely supported and reinforced along their entire lengths by the two adjacent closed tube members 14*a* and security rods 60 plus the fins support on the side jambs 30*c*.

In this manner, the reinforced pivot axis 18 of each louver member 14 provides additional strength and rigidity to each louver member to prevent bowing of the louver member and to provide additional security against forced entry, since it is virtually impossible to break through the louver members when they are completely supported along their upper and lower longitudinal edges 30*a*, 30*b* by the reinforced closed tube members 14*a* and security rods 60. In addition, the axis of rotation 18 has been made stronger, so that the pivoting of each louver member 14 will be less prone to damage and have a longer life.

Tests have also been made with regard to wind conditions. A louver assembly having the reinforced tube members 14*a* and aluminum security rods 60 was tested successfully and withstood 180 pounds per square foot (268 MPH). When the aluminum security rods 60 are replaced with steel, such an arrangement would even further increase the strength of the louver assembly. With tempered steel rods 60, the window would be appropriate for detention and would also be more appropriate in high-crime areas as a deterrent for preventing break-ins and the like.

As also shown in FIG. 4, a portion of the closing section 30 of the louver member may be deleted to form a cut out 64, and longitudinally-extending channel members 66 and 68 may be formed on the outer surface of the closing section of the louver member. These channel members 66, 68, in the preferred embodiment, are extruded with the entire louver member 14. A glass insert 70 is then adapted to be slidingly received within longitudinally-extending channel members 66, 68. In this manner, by having the cut-out section 64 formed in the louver members, light is allowed to pass through the louver assembly without substantially affecting the rigidity and strength of each louver member. In fact, the longitudinally-extending channel members 66, 68 operate in a manner similar to tube member 14*a* in providing additional strength and rigidity to the louver member to prevent bowing thereof.

Louver member 14 can be modified, as shown in FIG. 5, so that slot 67 accepts glass, aluminum, or wooden slats. The lower longitudinal edge 30*b* of each slat rests against slot area 69. Weatherstripping 30*c* is adapted to be placed in slot 69.

In view of the foregoing, it should be clear that as a result of the present invention, an improved louver assembly has been provided which has additional strength and rigidity, which is completely weather tight, even in high-wind load conditions, and which is useful to prevent break-ins in high-crime areas.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A louver assembly comprising:

a) a frame including vertical side jambs, sealing fins on the side jambs, a head, a sill, and a central opening;

b) a plurality of vertically-spaced, substantially-straight horizontal louver members extending longitudinally across said central opening between said side jambs, each of said louver members including a closing section and an actuating section and a pivot member between said closing section and said actuating section, and each of said closing sections including upper and lower longitudinal edges;

c) means for pivotally mounting each of said louver members on said side jambs about said respective pivot members;

d) the pivot member of each of said louver members being formed by a closed hollow tube extending from one edge of the louver member to the other edge to provide structural strength and to reinforce each of said louver members;

e) a security rod disposed in each of said closed hollow tubes along the entire length thereof and completely surrounded by said closed hollow tube to further reinforce each of said louver members;

f) locking means for preventing the removal of said security rods from the hollow tubes of said louver members; and g) actuating means attached to the actuating section of each of said louver members for pivoting said louver members between open and closed positions, so that in said closed position, the lower longitudinal edge of an upper louver member overlaps the pivot member of the adjacent lower louver member so that the upper and lower longitudinal edges of the closing section of said louver members are completely supported along their longitudinal lengths by said pivot member at the upper longitudinal edge thereof and by the pivot member of the adjacent lower louver member at the lower longitudinal edge thereof and also supported by the sealing fins of said side jambs.

2. A louver assembly in accordance with claim 1, wherein said closed hollow tubes are formed of aluminum.

3. A louver assembly in accordance with claim 1, wherein each of said louver members is an integral member formed from extruded aluminum.

4. A louver assembly in accordance with claim 1, wherein said security rod is a solid metal member.

5. A louver assembly in accordance with claim 1, wherein said locking means includes cross locking pins at each end of said security rods for preventing the removal of said security rods from the hollow tubes of said louver members.

6. A louver assembly in accordance with claim 1, wherein said closed hollow tubes are formed of steel.

7. A louver assembly in accordance with claim 1, wherein said security rod is formed of steel.

* * * * *